US008790747B2

(12) United States Patent
Kusaka et al.

(10) Patent No.: US 8,790,747 B2
(45) Date of Patent: Jul. 29, 2014

(54) METHOD AND APPARATUS FOR PRODUCING INSULATED WIRE

(75) Inventors: Hiroyuki Kusaka, Tokyo (JP); Koji Kuromiya, Tokyo (JP); Satoshi Saito, Tokyo (JP); Takashi Shigematsu, Shiga (JP); Akihiro Murakami, Tokyo (JP); Shinji Ichikawa, Tokyo (JP); Haruo Sakuma, Tokyo (JP); Shingo Nishijima, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 1253 days.

(21) Appl. No.: 12/531,363

(22) PCT Filed: Mar. 28, 2008

(86) PCT No.: PCT/JP2008/000793

§ 371 (c)(1),
(2), (4) Date: Apr. 8, 2010

(87) PCT Pub. No.: WO2008/126375

PCT Pub. Date: Oct. 23, 2008

(65) Prior Publication Data

US 2010/0203231 A1 Aug. 12, 2010

(30) Foreign Application Priority Data

Mar. 30, 2007 (JP) ..... 2007-091982

(51) Int. Cl.
*H01B 13/06* (2006.01)

(52) U.S. Cl.
USPC ..... 427/117; 118/DIG. 20

(58) Field of Classification Search
CPC ..... B01D 2239/025; B01D 2239/0654; B01D 2239/1233; B01D 2325/12; B01D 69/12; B01D 71/34; B21C 1/003; B21C 1/00; B21C 23/005; B21C 37/042; B21C 23/30; B21C 33/004; B21C 25/025; B21C 25/04; B21C 33/00; B21C 3/00; B29L 2031/707; H01B 13/16
USPC ..... 427/422, 117; 118/DIG. 20
See application file for complete search history.

(56) References Cited

U.S. PATENT DOCUMENTS

| | | | | |
|---|---|---|---|---|
| 3,821,511 | A * | 6/1974 | Sugano et al. | 219/155 |
| 5,151,147 | A * | 9/1992 | Foster et al. | 156/244.12 |
| 6,288,342 | B1 * | 9/2001 | Ueoka et al. | 174/137 B |
| 2002/0112344 | A1 * | 8/2002 | Harada et al. | 29/605 |
| 2005/0182180 | A1 * | 8/2005 | Martin et al. | 524/501 |

(Continued)

FOREIGN PATENT DOCUMENTS

| | | | |
|---|---|---|---|
| JP | 52130410 | * | 11/1977 |
| JP | 55014266 | * | 1/1980 |

(Continued)

*Primary Examiner* — Michael Cleveland
*Assistant Examiner* — Tabassom Tadayyon Eslami
(74) *Attorney, Agent, or Firm* — Kubotera & Associates, LLC

(57) ABSTRACT

Disclosed is a method of producing an insulated electric wire, in which a primary coating layer including at least an enamel-baking layer is formed on a metallic conductor to form a primary coated electric wire, and a secondary coating layer is extrusion-formed on the primary coating layer of the primary coated electric wire. The method includes an electric wire pre-heating process where a surface of the primary coating layer is pre-heated using an electric wire pre-heating unit, and a resin extrusion process where a secondary coating layer is extrusion-formed on the pre-heated primary coating layer using a resin extrusion unit. Further disclosed is an apparatus for producing an insulated electric wire.

4 Claims, 4 Drawing Sheets

(56) References Cited

U.S. PATENT DOCUMENTS

| | | | | |
|---|---|---|---|---|
| 2008/0128154 | A1* | 6/2008 | Faust et al. | 174/120 R |
| 2008/0156059 | A1* | 7/2008 | Quick et al. | 72/289 |

FOREIGN PATENT DOCUMENTS

| | | | | |
|---|---|---|---|---|
| JP | 58-37617 | A | | 3/1983 |
| JP | 59127312 | | * | 7/1984 |
| JP | 411204229 | | * | 7/1999 |
| JP | 2002-109974 | A | | 4/2002 |
| JP | 2005-203334 | | * | 7/2005 |
| JP | 2005-203334 | A | | 7/2005 |
| WO | WO/9632525 | | * | 10/1996 |
| WO | WO/2006/061360 | | * | 6/2006 |

* cited by examiner

METHOD AND APPARATUS FOR PRODUCING INSULATED WIRE

TECHNICAL FIELD

The present invention relates to a method of producing an insulated electric wire and an apparatus for producing the same.

BACKGROUND ART

Conventionally, an insulated electric wire has been manufactured as follows. For example, a conductor having a circular cross-section passes through a cassette roller die (CRD) equipped with a pair of rollers to be wire-drawn to have a flat cross-section. Then, the conductor passes through an annealing furnace to remove distortions occurred in the wire-drawing process, so that the conductor is softened. Consecutively, the conductor is coated with enamel varnish and passes through a baking furnace to form an enamel-baking layer on the conductor. The resultant insulated electric wire having a flat cross-section is wound. One of these techniques is disclosed in Patent document 1.

In recent years, electrical devices, industrial motors, automobile driving motors and the like are made to be energy-saving, and miniaturized with high performance. Accordingly, an attempt has been made to control the motors through an inverter. Therefore, the insulated electric wire used in the motors tends to be exposed to environments where a corona discharge may occur (a discharge caused by a non-uniform electrical field occurring around a sharp electrode; also known as a local breakage discharge). In order to prevent the corona discharge from occurring in the insulated electric wire, it is known as being effective to increase a thickness of the enamel-baking layer baked on the conductor of the insulated electric wire (refer to Paschen's law). However, since the enamel varnish is expensive, the thicker insulation layer leads to higher production cost.

Therefore, the present applicant has developed an insulated electric wire D2 as illustrated in FIG. 3 (see Patent document 2). That is, in the insulated electric wire D2 as illustrated in FIG. 3, a primary coating layer B including an enamel coating layer B1 is formed on an outer side of the conductor A to form an electric wire D1 (hereafter, referred to as a primary coated electric wire D1). A resin (hereinafter referred to as an extrusion resin) is extrusion-coated (or extruded) on the outer side of the primary coating layer B to form a secondary coating layer C. Accordingly, even when a less expensive extrusion resin is used, it is possible to prevent the corona discharge. In order to obtain the insulated electric wire D2 as structured above, Patent document 2 discloses a technique where the extrusion is carried out with an extrusion resin heated up to a desired temperature.

Patent document 3 discloses a technique, in which when an extrusion resin of polyetheretherketone (PEEK) is formed on a surface of a conductor to form an insulated electric wire, the conductor is pre-heated to suppress reduction in a resin temperature, and an insulation coat is formed on a surface of the conductor, thereby making it possible to eliminate a process of pre-heating the conductor.

Patent document 1: Japanese Patent No. 3604337

Patent document 2: Japanese Patent Laid-Open Publication No. Hei 2005-203334

Patent document 3: Japanese Utility Model Laid-Open Publication No. Sho 58-37617.

DISCLOSURE OF THE INVENTION

Technical Problem

The manufacturing method disclosed in Patent document 2 may produce the insulated electric wire having an improved anti-corona discharge. However, the technique needs to be further improved, in order to produce a high quality electric wire in terms of anti-corona properties and bonding strength in a cost-saving and efficient way. An anti-corona electric wire has a corona discharge initiation voltage Vp of higher than 1,200 V and a bonding strength S (also known as a peeling strength, a peel strength, or an adhesiveness strength) of higher than 90 mg/mm. Hereafter, the bonding strength S will be further explained in more detail.

In particular, when the specification of the insulated electric wire such as sizes and materials thereof is changed, it is difficult to easily determine a manufacturing condition. Further, the bonding strength between the primary coating layer and the secondary coating layer becomes unacceptably low. In addition, in the technique disclosed in Patent document 3 for forming the primary coating layer, the bonding strength between the primary coating layer and the secondary coating layer would be insufficient.

As described above, in the conventional techniques, it is difficult to easily manufacture a high quality insulated electric wire having anti-corona characteristics at a low cost.

In the specification, the bonding strength S is defined as a value obtained from $S=N/w$, where w is a width of a notch formed in a test material, and N is a load required for peeling off when pulled with a tension tester (stereograph).

Further, the corona discharge initiation voltage Vp is defined as a voltage, at which a corona discharge is initiated due to an electrical potential difference when neighboring electric wires contact.

In view of the above problems, it is an object of the present invention to provide a method of and an apparatus for stably producing a high quality insulated electric wire having anti-corona characteristics at a low cost.

Technical Solution

According to the inventors' review, in the techniques disclosed in Patent document 2, only the heated resin is extruded. Therefore, occasionally the surface of the primary coating layer may be sufficiently and firmly bonded with the extruded resin, thereby lowering the bonding strength. In addition, when the insulated electric wire has a non-circular cross-section, a small curvature of radius occurs locally. Accordingly, the primary coating layer and the secondary coating layer may be peeled off from each other, thereby lowering the adhering strength.

In a method of producing an insulated electric wire, a primary coating layer including at least an enamel-baking layer is formed on a metallic conductor to form a primary coated electric wire, and a secondary coating layer is extrusion-formed on the primary coating layer of the primary coated electric wire. The method includes an electric wire pre-heating process where the surface of the primary coating layer is pre-heated using an electric wire pre-heating means, and a resin extrusion process where a secondary coating layer is extrusion-formed on the pre-heated primary coating layer using a resin extrusion means.

In case where the outermost layer of the primary coating layer is the enamel-baking layer, in the electric wire pre-heating process the surface of the primary coating layer is pre-heated up to below the glass transition point of the enamel-baking layer.

In addition, an adhesive layer is formed on the enamel-baking layer of the primary coating layer. The adhesive layer is bonded to the secondary coating layer. Further, in case where the outermost layer of the primary coating layer is the adhesive layer, in the electric wire pre-heating process the surface of the primary coating layer is pre-heated up to above the glass transition point of the adhesive layer.

In addition, in case where an adhesiveness enhancer is added to the secondary coating layer, in the electric wire pre-heating process the surface of the primary coating layer is pre-heated up to above the minimum temperature at which the adhesiveness enhancer is chemically reacted with the primary coating layer.

In addition, in the electric wire pre-heating process the surface of the primary coating layer is pre-heated up to below the thermal decomposition temperature of the primary and secondary coating layers.

Further, in the electric wire pre-heating process the surface of the primary coating layer is pre-heated without contacting the primary coated electric wire.

In addition, the method further comprises an electric wire straightening process where the pre-heated primary coated electric wire is roughly straightened using an electric wire straightening means and then is supplied to the The method further comprises an electric cooling process where the insulated electric wire having the secondary coating layer extrusion-formed thereon is cooled using an electric wire cooling means, and a coat thickness measuring process where the resin coat thickness of the cooled insulated electric wire is measured using a coat thickness measuring means.

In addition, the method comprises a conductor supply process where the conductor is continuously supplied using a conductor supply means, a conductor processing process where the conductor supplied from the conductor supply process is rolled using a pair of rolls which is free-rotated without a drive mechanism and passes through a drawing die to be wire-drawn to have a desired shape, a conductor annealing process where the wire-drawn conductor in the conductor processing process is annealed using a conductor annealing means, a coat baking process where a primary coating layer is baked and formed using a coat baking means, the electric wire pre-heating process where the primary coated electric wire formed with a primary coating layer in the coat baking process is pre-heated using an electric wire pre-heating means, an electric wire straightening process where the primary coated electric wire pre-heated in the electric wire pre-heating process is roughly straightened using an electric wire straightening means, a resin extrusion process where an extrusion resin is extrusion-formed on the primary coating layer of the primary coated electric wire that is straightened in the electric wire straightening process by means of a resin extrusion means, an electric wire cooling process where the insulated electric wire having the extruded resin formed thereon in the resin extrusion process is cooled using an electric wire cooling means so that the extruded resin is integrally and solidly adhered to the primary coating layer, a coat thickness measuring process where the resin coat thickness of the insulated electric wire cooled in the electric wire cooling process is measured using a coat thickness measuring means, and an electric wire winding process where the insulated electric wire with the extruded resin coated thereon in the resin extrusion process is taken-up using an electric winding means. Here, the conductor supply means, the conductor processing means, the conductor annealing means, the coat baking means, the electric wire pre-heating means, the electric wire straightening means, the resin extrusion means, the electric wire cooling means, the coat thickness measuring means, and the electric wire winding means are disposed in a tandem arrangement. Further, the entire processes from the conductor supply process to the electric wire winding process are carried out in an assembly line manner.

Furthermore, the extrusion resin constituting the secondary coating layer is polyphenylene sulfide resin.

In addition, a primary coating layer including at least an enamel-baking layer is formed on a metallic conductor to form a primary coated electric wire, and a secondary coating layer is extrusion-formed on the primary coating layer of the primary coated electric wire. The apparatus includes an electric wire pre-heating means for pre-heating the surface of the primary coating layer, and a resin extrusion means for extrusion-forming a secondary coating layer on the pre-heated primary coating layer.

In case where the outermost layer of the primary coating layer is the enamel-baking layer, the electric wire pre-heating means is set up to pre-heat the surface of the primary coating layer up to below the glass transition point of the enamel-baking layer.

In addition, an adhesive layer is formed on the enamel-baking layer of the primary coating layer. The adhesive layer is bonded to the secondary coating layer. Further, in case where the outermost layer of the primary coating layer is the adhesive layer, the electric wire pre-heating means is set up to pre-heat the surface of the primary coating layer up to above the glass transition point of the adhesive layer.

In addition, in case where the outermost layer of the primary coating layer is an enamel-baking layer formed by adding an adhesiveness enhancer, the electric wire pre-heating means is set up to pre-heat the surface of the primary coating layer up to above the minimum temperature at which the adhesiveness enhancer is chemically reacted with the primary coating layer.

In addition, the electric wire pre-heating means is set up to pre-heat the surface of the primary coating layer below the thermal decomposition temperature of the primary and secondary coating layers.

Further, the electric wire pre-heating means is set up to pre-heat the surface of the primary coating layer without contacting the primary coated electric wire.

In addition, the apparatus further comprises an electric wire straightening means for roughly straightening the pre-heated primary coated electric wire and then supplying to the resin extrusion means.

The apparatus further comprises an electric cooling means for cooling the insulated electric wire having the secondary coating layer extrusion-formed thereon, and a coat thickness measuring means for measuring the resin coat thickness of the cooled insulated electric wire.

According to the present invention, after the resin extruded electric wire is cooled by the electric wire cooling means, the thickness of the resin coat formed on the electric wire is measured by means of the coat thickness measuring means. Thus, an electric wire having an appropriate thickness of resin coating to prevent corona discharge can be manufactured. Furthermore, for example, a defective portion having a thinner resin coating layer may be removed.

In addition, the apparatus comprises a conductor supply means for continuously supplying the conductor, a conductor processing means where the conductor supplied from the conductor supply means is rolled using a pair of rolls which is free-rotated without a drive mechanism and passes through a drawing die to be wire-drawn to have a desired shape, a conductor annealing means for annealing the conductor wire-drawn by the conductor processing means, a coat baking means for baking a primary coating layer to form a baking layer, the electric wire pre-heating means for pre-heating the primary coated electric wire formed with a primary coating layer by means of the coat baking means, an electric wire straightening means for roughly straightening the primary coated electric wire pre-heated by the electric wire pre-heating means, a resin extrusion means for extrusion-forming an extrusion resin on the primary coating layer of the primary coated electric wire that is straightened by the electric wire straightening means, an electric wire cooling means for cooling the insulated electric wire having the extruded resin formed thereon by the resin extrusion means so that the extruded resin is integrally and solidly adhered to the primary coating layer, a coat thickness measuring means for measuring the resin coat thickness of the insulated electric wire cooled by the electric wire cooling means, and an electric wire winding means for taking up the insulated electric wire with the extruded resin coated thereon by the resin extrusion means. Here, the conductor supply means, the conductor processing means, the conductor annealing means, the coat baking means, the electric wire pre-heating means, the electric wire straightening means, the resin extrusion means, the electric wire cooling means, the coat thickness measuring means, and the electric wire winding means are disposed in a tandem arrangement.

The primary coating layer is pre-heated, and the extrusion resin such as polyphenylene sulfide resin (hereinafter, referred to as "PPS resin") or the like is extruded on the pre-heated primary coating layer, so that the adhesiveness between the secondary coating layer and the primary coating layer is increased to thereby enable to produce a high quality insulated electric wire having anti-corona discharge in a stable way.

That is, conventionally (for example, patent document 2), the extrusion resin is expected to smear well into the prominences and depressions in the surface of the primary coating layer and adhere thereto by increasing the temperature of the extrusion resin. In contrast, in the present invention, the surface of the primary coating layer is pre-heated such that the primary coating layer is sufficiently heated before extruding the extrusion resin. Therefore, the adhesiveness between the primary and secondary coating layers can be improved in a stable way.

By further increasing the temperature of the extrusion resin, the heat of the extrusion resin may be transferred to heat the primary coating layer. However, the extrusion resin may be thermally decomposed to cause an adverse effect and the temperature control cannot be easily performed. Further, the primary coating layer cannot be easily heated in a stable way by transferring the heat from the extrusion resin. Thus, the present invention is more preferable in manufacturing a high quality anti-corona insulated electric wire in a stable way.

Since the primary coating layer is not beyond the glass transition point, preferably the primary coating layer is not easily deformed even though foreign matters or the like contact the surface.

Since the adhesive layer is heated up to above the glass transition point, the adhesive layer is reliably softened when the extrusion resin is extruded and the adhesiveness with the surface of the secondary coating layer is reliably secured.

An adhesiveness enhancer (for example, isocyanate) is added to the secondary coating layer to chemically react the primary coating layer with the adhesiveness enhancer, thereby reliably improving the adhesiveness between the primary coating layer and the secondary coating layer.

Since the surface of the primary coating layer is pre-heated up to below the thermal decomposition temperature of the primary and secondary coating layers, the sufficient bonding strength in-between can be obtained, without degrading the primary and secondary coating layers.

Since the surface of the primary coating layer is pre-heated without contacting the primary coated electric wire, the deformation of the surface of the primary coating layer, which is easily caused by external force or pre-heating, can be avoided, thereby providing a good appearance to the insulated electric wire.

Since a roughly straightened primary coated electric wire is supplied to the resin extrusion process, the extruded resin can be formed on the primary coating layer of the electric wire in a uniform fashion (the electric wire being less eccentric inside the secondary coating layer.)

After the insulated electric wire having a secondary coating layer formed of the extrusion resin is cooled, the resin coat thickness of the conductor is measured using a coat thickness measuring means. Even in the case where the manufacturing conditions are changed in each process, preferably an electric wire having an appropriate thickness of resin coating to prevent corona discharge can be manufactured. Furthermore, preferably after forming a coating, a defective portion having a thinner resin coating layer can be found in the thickness measuring process and can be remove.

The primary coated electric wire is transferred directly to the electric wire pre-heating unit and the resin extrusion unit, without being taken-up to a bobbin or the like, thereby enabling to prevent moisture from being absorbed and built up inside the primary coated layer. Hereafter, further details thereon will be provided. In case where the primary coated electric wire D1 is stored for a long period of time, it absorbs moisture. Generally, it can be considered that the primary coated electric wire is taken up in a bobbin or the like and stored, and thereafter, resin extrusion can be carried out when necessary. Here, if the primary coated electric wire is stored as it is for a long period of time, the enamel-baking layer absorbs moisture. Thus, thereafter when it is used as an insulated electric wire, the moisture inside the primary coating layer expands and is swollen to make defects, in worse case, to adversely affect the insulation-resistance pressure of the insulated electric wire and the like. In order to avoid this problem, the pre-heating and resin extrusion are carried out directly on the primary coated electric wire in a tandem arrangement, without being taken-up to a bobbin or the like, thereby enabling to prevent moisture from being absorbed and built up inside the primary coated layer.

The PPS resin is less expensive than other resins such as, for example, enamel varnish or the like, and also has a good shaping property among resin materials suitable to use in the resin extrusion unit. In addition, the PPS resin can be extruded uniformly on the primary coating layer coated on the conductor.

Effects of the Invention

As described above, the present invention can provide a method and apparatus for producing an insulated electric wire, which can produce a quality insulated electric wire having a corona discharge resistance in stable and cost-saving manner.

Figure 1:
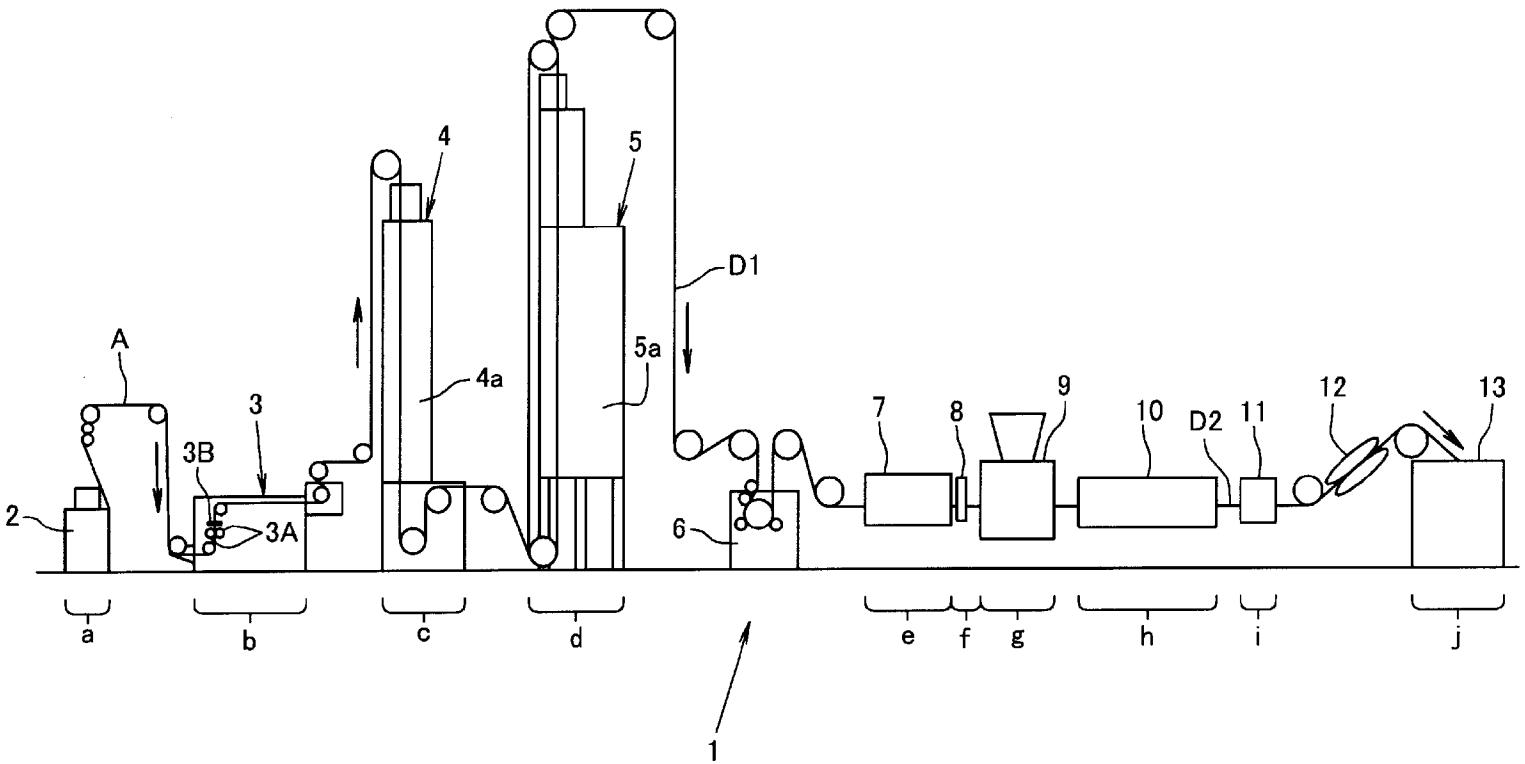
FIG. 1 is a flow diagram illustrating a process and an apparatus for producing insulated electric wire according to an embodiment of the invention.
Figure 2:
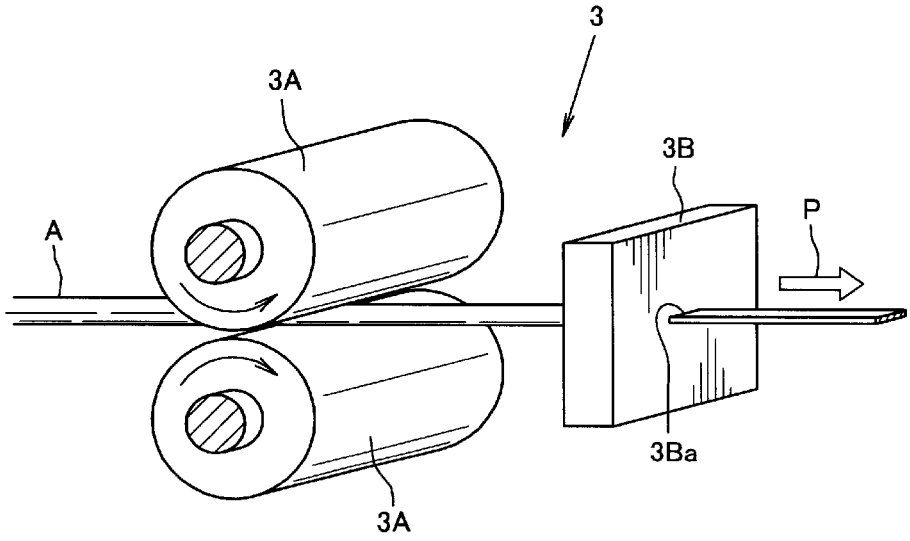
FIG. 2 is a schematic diagram illustrating a method of rolling a conductor in a conductor processing unit according to an embodiment of the invention.

DESCRIPTION OF REFERENCE NUMERALS a: Conductor supply process
b: Conductor processing process
c: Conductor annealing process
d: Coat baking process
e: Electric wire pre-heating process
f: Electric wire straightening process
g: Electric wire extrusion process
h: Electric wire cooling process
i: Coat thickness measuring process
j: Electric wire winding process
A: Conductor
B: Primary coat layer
C: Secondary coat layer
D1: Primary coated electric wire
D2: Insulated electric wire
1: Manufacturing apparatus
2: Conductor supply unit
3: Conductor processing unit
3A: Roll
3B: Drawing dies
4: Conductor annealing unit
4*a*: Annealing furnace
5*a*: Baking furnace
6: Pull-up unit
7: Electric wire pre-heating unit
8: Electric wire-straightening unit
9: Resin extrusion unit
10: Electric wire-cooling unit
11: Coat thickness-measuring unit
12: Pull-up unit
13: Electric wire winding unit

PREFERRED EMBODIMENTS OF THE INVENTION

Figure 3:
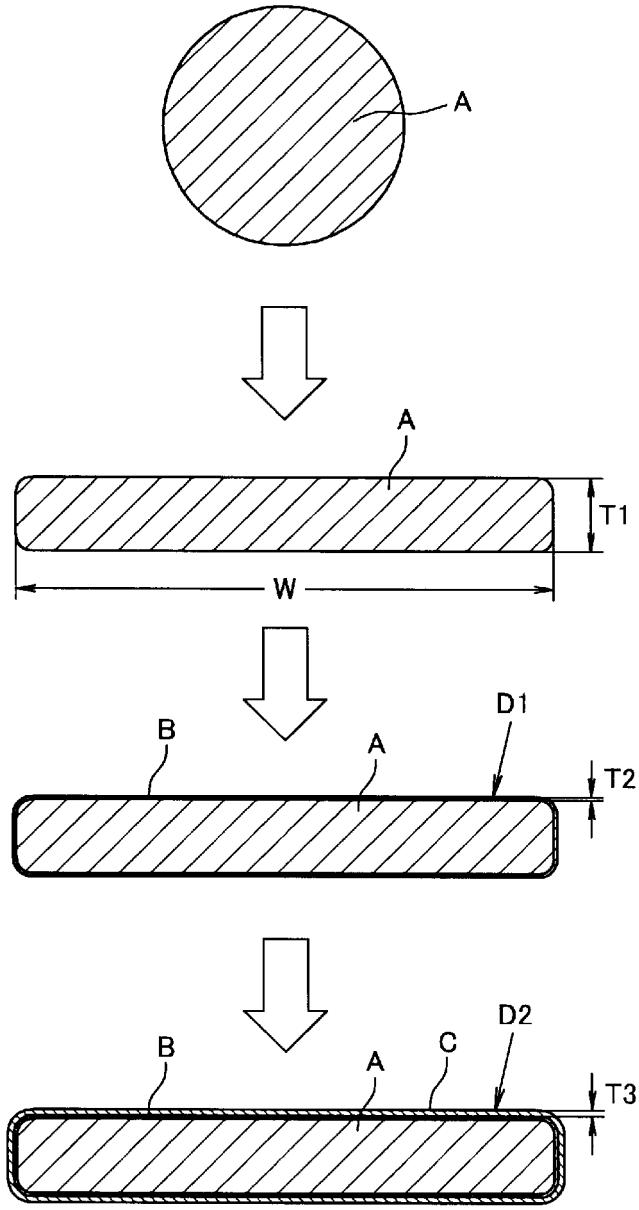
FIG. 3 is a cross-sectional view illustrating an insulated electric wire according to an embodiment of the invention.
Figure 4:
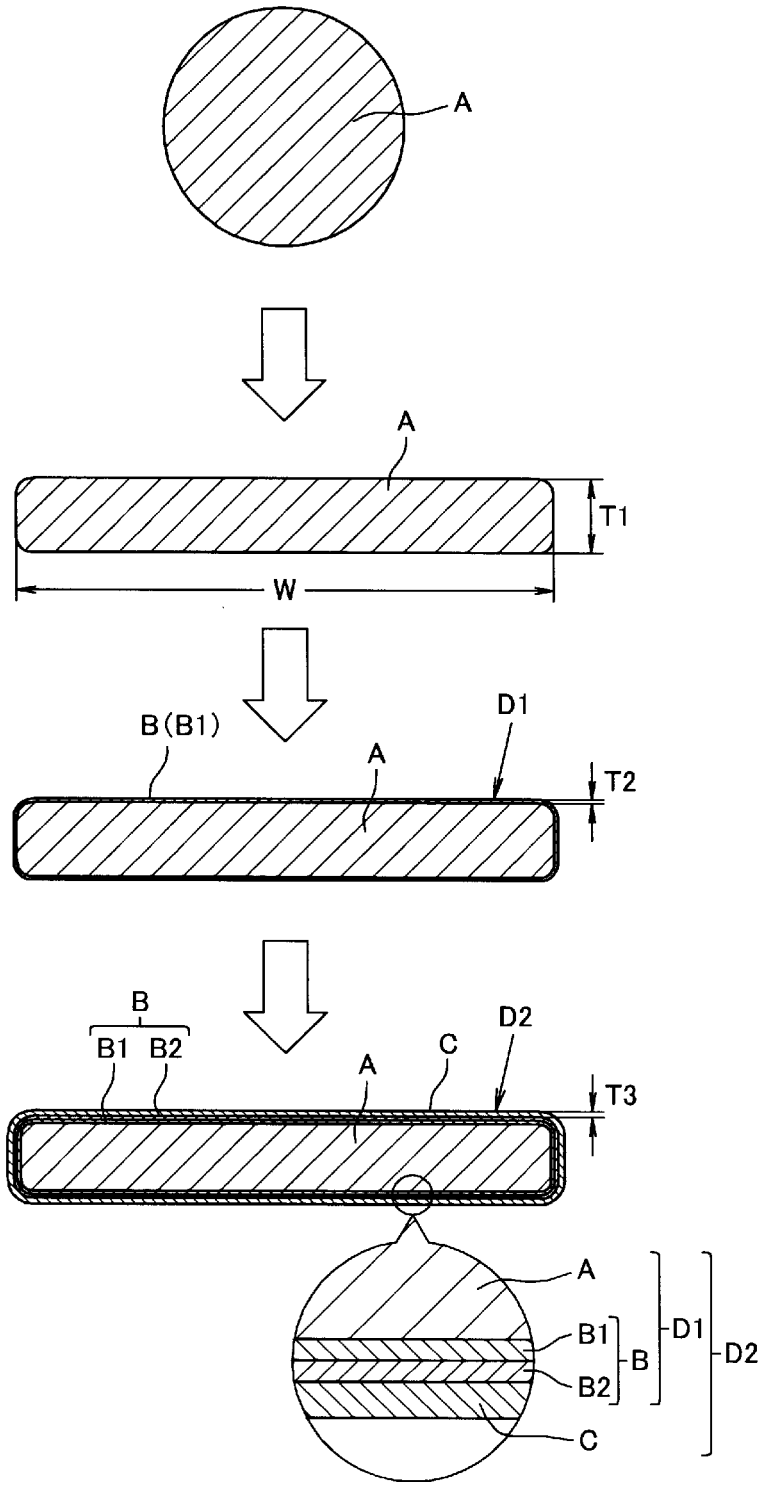
FIG. 4 is a cross-sectional view illustrating an insulated electric wire according to another embodiment of the invention.

FIG. 1 shows a method of producing an insulated electric wire D2 according to an embodiment of the invention, and an apparatus for producing the same. Here, mainly the insulated electric wire D2 as illustrated in FIG. 3 is explained as to its producing method, simultaneously describing the manufacturing of an insulated electric wire D2 as illustrated in FIG. 4.

As illustrated in FIG. 1, the apparatus 1 for producing the insulated electric wire D2 includes a conductor supply unit 2 in a conductor supply process a, a conductor processing unit 3 in a conductor processing process b, a conductor annealing unit 4 in a conductor annealing process c, a coat-baking unit 5 in a coat baking process d, a pull-up unit 6 right after the coat-baking unit 5, an electric wire pre-heating unit 7 in an electric wire pre-heating process e, an electric wire-straightening unit 8 in an electric wire straightening process f, a resin extrusion unit 9 in a resin extrusion process g, an electric wire-cooling unit 10 in an electric wire cooling process h, a coat thickness-measuring unit 11 in a coat thickness measuring process I, a pull-up unit 12 right after the coat thickness-measuring unit 11, and an electric wire winding unit 13 in an electric wire winding process j in a tandem arrangement and in the described order. Hereafter, the respective units will be explained.

In the conductor supply process a, the conductor supply unit 2 may be formed of a well-known supply unit and the like, and is driven by a driving means such as a motor. For example, a conductor A having a circular cross-section, which is supplied from a conductor manufacturing plant or the like, is continuously supplied to the conductor processing unit 3 in the conductor processing process.

In the conductor processing process b, the conductor processing unit 3 is not driven by a driving means such as a motor or the like, but is comprised of a pair of rolls (upper and lower rolls 3A) each being free-rotating by contact friction of the conductor A, and a drawing die 3B. The conductor A is rolled by the rolls 3A so to have a flat cross-section. The drawing die 3B draws the rolled conductor A to have a desired shape and dimension.

The upper and lower rolls 3A are disposed in parallel to face each other so that the conductor A having a circular cross-section is rolled into a flat cross-section. That is, the circular conductor A is pulled up by the pull-up unit 6 (will be described hereafter) in a drawing direction P. Thus, the conductor A is transferred between the rolls 3A while free-rotating the rolls. Since the diameter of the conductor A is greater than the gap between the rolls 3A, the conductor A is rolled into a flat cross-section when passing through between the upper and lower rolls 3A. In addition, the conductor A may be rolled by a pair of left and right rolls 3A.

Here, the pair of rolls 3A is free-rotating by contact friction of the conductor A, not by a driving means such as a motor or the like. That is, the conductor A having a larger diameter than the gap between the rolls 3A passes through between the rolls 3A and simultaneously is pulled up by the pull-up unit in the drawing direction. Thus, the rolls 3A are free-rotated by the contact friction and the conductor A is rolled to have a flat cross-section while passing between the rolls 3A. In this way, since the free-rotating rolls 3A does not have a forcible driving means, the conductor A is rolled depending on the passing speed of the conductor A between the rolls 3A. In the drawing process, the tension force exerted on the conductor A may be varied depending upon the diameter of the conductor A and the material thereof.

The drawing die 3B has a flat cross-section hole 3Ba having a pre-determined dimension such as thickness, width, chamfered edge and radius. The conductor A rolled by the pair of rolls 3A is inserted into the flat cross-section hole 3Ba and pulled up by the pull-up unit 6 in the drawing direction P, thereby drawing the conductor A to have a flat cross-section. See FIG. 3. The pull-up unit 6 will be further described hereinafter.

Preferably, the drawing die 3B may employ a diamond die or similar one, which has been widely used, considering the drawing precision and the life span. In addition, the drawing die 3B may have different shapes of hole to draw the conductor to have desired cross-sections different from the flat cross-section of this embodiment. Further, similar to the rolls 3A, in view of prevention of wire-breakage and extension of the lifespan of the die, the reduction rate is preferably 5~30%, more preferably 10~25% in case of pure copper conductor.

In the conductor annealing process c, the conductor annealing unit 4 includes an annealing furnace 4*a* and the processed conductor A in the conductor processing unit 3 is heat-treated while passing inside the annealing furnace 4*a*. Thus, distortions caused by rolling and drawing are removed to thereby soften the conductor A.

In the coat baking process d, the coat-baking unit 5 includes a baking furnace 5*a*, where an enamel varnish is coated and baked to form an enamel-baking layer B1 of a primary coating layer B. The conductor A annealed in the conductor annealing unit 4 is supplied into the baking furnace 5*a*, where the primary coating layer B is baked to form a primary coated electric wire D1.

In addition, as illustrated in FIG. 4, an adhesive layer B2 may be formed on the enamel-baking layer B1. In this case, after formation of the enamel-baking layer B1, enamel varnish constituting the adhesive layer B2 is coated and again is baked inside a baking furnace 5*a* to form the adhesive layer B2.

The pull-up unit 6 positioned right after the baking furnace 5*a* is driven by a driving means such as a motor. The pull-up unit 6 provides a tension force toward the drawing direction P to the conductor A, which passes through the hole of the drawing die 3B, simultaneously while transferring the conductor A (being supplied from the conductor supply unit 2) toward between the rolls 3A of the conductor processing unit 3. On the other hand, the tension force may vary with the diameter of the conductor A and the material thereof.

In the electric wire pre-heating process e, the electric wire pre-heating unit 7 includes a far-infrared radiation heater (not shown) for heating air to a desired temperature (for example, around 600° C.; hereinafter, may be referred to as "hot air"), and air blower (not shown) for blowing the over-heated air by the far-infrared radiation heater toward a primary coated electric wire D1. The hot air is sprayed on the primary coated electric wire D1 being supplied from the coat-baking unit 5 to uniformly heat the electric wire D1. In addition, the primary coated electric wire is pre-heated up to a surface temperature to improve the adhesiveness of a resin, which will be described hereinafter.

Here, the pre-heating by the electric wire pre-heating unit 7 will be further explained.

In the electric wire pre-heating unit 7, the primary coated electric wire D1 is pre-heated to improve wettability and reactivity of the primary coating layer B. Thus, the adhesiveness between the primary coating layer B and the secondary coating layer C can be reliably enhanced. The pre-heating temperature of the primary coated electric wire D1 is at least higher than room temperature since the pre-heating is intended to increase the temperature of the primary coating layer B higher than non-heated state.

For example, in case where the insulated electric wire D2 as shown in FIG. 3, an adhesiveness enhancer such as isocyanate may or may not be added to the extruded resin, which will be a secondary coating layer C. Therefore, it is preferable to adjust the pre-heating temperature in the electric wire pre-heating unit 7. Here, the adhesiveness enhancer means an additive for improving the adhesiveness with the primary coating layer B.

In case where an adhesiveness enhancer is not added, the higher the temperature increases, the better the adhesiveness becomes, since the wettability of the enamel-baking layer B1 is improved. In addition, the surface of the enamel-baking layer B1 is increased up to higher than a glass transition temperature Tg, thereby enabling to further improve the adhesiveness with the primary coating layer B (For example, in case where the enamel-baking layer B1 is formed of polyamideimide resin, the glass transition temperature Tg is about 270~300° C. and the pre-heating is performed above this temperature.) In contrast, if the enamel-baking layer B1 is heated to less than the glass transition temperature Tg, preferably the enamel-baking layer B1 is not easily deformed when being touched with an object.

In case where an adhesive enhancer is added to the extruded resin, similarly the higher pre-heating temperature is better as much. However, considering the sufficient chemical reaction between the adhesiveness enhancer and the primary coating layer B, it is preferable that the temperature of the adhesiveness enhancer is increased up to higher than the minimum temperature required for the chemical reaction. For example, in case where the primary coating layer is formed of polyamideimide, the secondary coating layer C is formed of PPS resin and the adhesiveness enhancer is isocyanate, the minimum reaction temperature between the primary coating layer and the adhesiveness enhancer is about 140° C. Therefore, it is preferable that the enamel-baking layer B1 is pre-heated up to above 140° C.

Furthermore, as illustrated in FIG. 4, an adhesive layer B2, as a primary coating layer B of the insulated electric wire D2, may be formed on the enamel-baking layer B1, thereby improving the bonding force with the secondary coating layer C. In this case, it is preferable that the electric wire D1 is pre-heated to above the glass transition temperature of the adhesive layer B2. For example, as an adhesive layer B2, polyphenylenesulfone (PPSU) resin as an enamel varnish may be baking-formed together with the enamel-baking layer B1. In this case, since the glass transition temperature of the PPSU resin is about 220° C., it is preferable that the adhesive layer B2 is pre-heated to above 220° C.

On the other hand, considering reduction in the surface temperature of the primary coating layer B during the supply of the primary coated electric wire D1 from the electric wire pre-heating unit 7 to the resin extrusion unit 9, it desirable that the pre-heating temperature is set up somewhat higher. In addition, in order for such temperature reduction to be minimized, it is desirable that the distance between the electric wire pre-heating unit 7 and the resin extrusion unit 9 is as short as possible.

The pre-heating method of the primary coated electric wire D1 is not limited to the above hot air blowing. Since the enamel-baking layer B1 is softened at the temperature above the glass transition point Tg, it is preferable that the primary coated electric wire D1 is heated indirectly by blowing hot air, i.e., a non-contact heating method as in this embodiment. This is because the shape of the enamel-baking layer B1 may be deformed in case of a contact heating technique where the primary coated electric wire D1 is brought into direct contact with a heat source.

Here, the primary coated electric wire D1 coming from the coat-baking unit 5 is transferred directly to the electric wire pre-heating unit 7, without being taken-up to a bobbin or the like. In case where the primary coated electric wire D1 is stored for a long period of time, it absorbs moisture. Thus, when it is used as an insulated electric wire D2 (which will be described hereafter), the moisture inside the primary coating layer B expands and is swollen to make defects, in worse case, to adversely affect the insulation-resistance pressure of the insulated electric wire D2 and the like. In order to avoid this problem, as above, the apparatus 1 is configured such that the primary coated electric wire is transferred directly to the electric wire pre-heating unit 7 from the coat-baking unit 5 and coated with a secondary coating layer C, thereby preventing moisture from being built up inside the primary coated layer B.

In the electric wire straightening process f, the electric wire-straightening unit 8 includes a guide roller (not shown) for straightening the primary coated electric wire D1. The electric wire-straightening unit 8 straightens the primary coated electric wire D1 being supplied from the electric wire pre-heating unit 7. If the primary coated electric wire D1 is supplied to the resin extrusion unit 9 at the state of being bent or distorted, the secondary coating layer C cannot be easily formed on the primary coating layer B in a uniform thickness, i.e., the thickness of he secondary coating layer tends to be locally thinner or thicker, leading to fluctuation in the thickness. Therefore, as described above, the electric wire-straightening unit 8 straightens the primary coated electric wire D1 before supplying it to the resin extrusion unit 9. In this way, the primary coated electric wire D1 can passes through the center of the extrusion die of the resin extrusion unit 9 in a stale fashion. Thus, the resin is extruded uniformly on the primary coating layer B of the primary coated electric wire D1 to thereby avoid fluctuation in the thickness thereof.

In the resin extrusion process g, the resin extrusion unit 9 includes a resin extruder for extruding a resin on the primary coating layer B of the primary coated electric wire D1. The extruded resin is uniformly formed on the primary coating layer B of the primary coated electric wire D1, which has been straightened 8 by the electric wire-straightening unit 8, thereby forming a secondary coating layer C having a uniform thickness.

In the electric wire cooling process h, the electric wire-cooling unit 19 includes a cooling bath, for example where the insulated electric wire is dipped in a liquid such as water. For example, the electric wire-cooling unit 10 includes a cooling bath (not shown), where the insulated electric wire D2 formed with the secondary coating layer C is dipped into a liquid, and an air blower (not shown) for spraying air to the insulated electric wire coming out from the liquid of the cooling bath to dry the electric wire D2. The insulated electric wire D2 being supplied from the resin extrusion unit 9 is dipped into a liquid to cool the electric wire, to thereby improve the adhesiveness of the resin to the primary coating layer B to be integrally bonded together. Consecutively, air being supplied from the air blower is sprayed to the insulated electric wire D2 coming out from the liquid of the cooling both to dry the electric wire.

The coat thickness-measuring unit 11, which is disposed right after the electric wire-cooling unit 10, includes a well-known thickness measuring tool for measuring and calculating the diameter of the entire insulated electric wire D2 and the thickness of the secondary coating layer C.

The pull-up unit 12, which is disposed right after the coat thickness-measuring unit 11, is driven by a drive mechanism such as a motor or the like. The pull-up unit 12 pulls up individually the insulated electric wire D2 finished with the resin extrusion, and simultaneously provides a tension force continuously to the extent that the insulated electric wire D2 remains straightened. That is, the tension force is strongly exerted on the conductor A from the coat baking process d to the resin extrusion process g, thereby preventing distortion and the like. On the other hand, the tension force being exerted on the insulated electric wire D2 may vary with the diameter of the insulated electric wire D2 and the material thereof.

In the electric wire winding process j, the electric wire winding unit 13 is driven by a drive mechanism such as a motor or the like. The electric wire winding unit 13 continuously winds up the insulated electric wire D2 being supplied from the resin extrusion unit 9.

Hereafter, a method of producing an insulated electric wire D2 using the above-constructed apparatus 1 will be explained. The method of producing the insulated electric wire D2 conducts, in a tandem arrangement, a conductor supply process a, a conductor processing process b, a conductor annealing process c, a coat baking process d, an electric wire pre-heating process e, an electric wire straightening process f, a resin extrusion process g, an electric wire cooling process h, a coat thickness measuring process i, and an electric wire winding process j.

First, as illustrated in FIG. 1, in the conductor supply process a, a conductor A, which is a raw material supplied to the conductor supply unit 2, is continuously supplied to the conductor processing unit 3 in the conductor processing process b.

In the conductor processing process b, a conductor A having a circular cross-section is conveyed into between the rolls 3A of the conductor processing unit 3, and simultaneously is tensioned in the drawing direction P by the pull-up unit 6. The pair of rolls 3A is free-rotated by the contact resistance of the conductor A, so that the conductor A being transferred to between the rolls 3A is rolled to have a flat cross-section. At this time, since the diameter of the conductor A being supplied from the conductor supply unit 2 is larger than the gap between the rolls 3A, the conductor A is rolled to have a flat cross-section when passing through between the rolls 3A. In this way, the rolled conductor A by the rolls 3A is inserted into and passes through the flat cross-section hole 3Ba of the drawing die 3B. The conductor A passing through the flat cross-section hole 3Ba is pulled up by the pull-up unit 6 in the drawing direction P while being drawn to have a flat cross-section, and then supplied to the conductor annealing unit 4 in the conductor annealing process c.

In the conductor annealing process c, the conductor A being supplied to the annealing furnace 4*a* of the conductor annealing unit 4 is annealed and at the same time distortion of the conductor A generated during the rolling and drawing is removed. The softened conductor A is supplied to the coat-baking unit 5 in the coat baking process d.

In the coat baking process d, enamel varnish is coated on the conductor A being supplied to the baking furnace 5*a* of the coat-baking unit 5, and then baked to form a primary coating layer B formed of an enamel-baking layer B1. The resultant conductor A is supplied to the electric wire pre-heating unit 7 in the electric wire pre-heating process e. In addition, the baking furnace 5*a* may be structured such that the primary coated electric wire D1 repeatedly passes through the furnace.

In the electric wire pre-heating process e, the electric wire pre-heating unit sprays hot-air to the primary coated electric wire D1 to heat the primary coated electric wire D1 uniformly. That is, the primary coated electric wire D1 is pre-heated to have a surface temperature capable of increasing the resin adhesiveness, which will be described hereinafter. Then, it is supplied to the electric wire-straightening unit 8 in the electric wire straightening process f.

In the electric wire straightening process f, the pull-up unit 12 provides a tension force continuously to the primary coated electric wire D1 being supplied to the electric wire-straightening unit 8, to the extent that the electric wire remains straightened. Then, the primary coated electric wire D1 straightened in the electric wire pre-heating unit 7 is supplied to the resin extrusion unit 9 in the resin extrusion process g.

In the resin extrusion process g, the resin extrusion unit 9 extrudes a resin uniformly on the primary coating layer B of the primary coated electric wire D1 to form a secondary coating layer C. Thereafter, it is supplied to the electric wire-cooling unit 10 in the electric wire cooling process h.

In the electric wire cooling process h, the insulated electric wire D2 is dipped into a liquid stored in the cooling bath of the electric cooling unit 10 to cool the electric wire. Here, the resin adhesiveness to the primary coating layer B is enhanced and then integrally and firmly bonded together. The insulated electric wire D2 coming out from the liquid of the cooling bath is dried by spraying air from an air blower. Thereafter, the insulated electric wire D2 coated with a secondary coating layer C, which is formed of PPS resin, is supplied to the coat thickness-measuring unit 11 in the coat thickness measuring process i.

In the coat thickness measuring process i, the coat thickness-measuring unit 11 measures the thickness of the resin coat of the insulated electric wire D2 (the thicknesses of the primary coating layer B and the secondary coating layer C formed thereon). After that, the insulated electric wire D2 is supplied to the electric wire winding unit 13 in the electric wire winding process j.

In the electric wire winding process j, the electric winding unit 13 continuously winds up the insulated electric wire D2. On the other hand, in case where the thickness of the secondary coating layer C, which has been measured by the coat thickness-measuring unit 11, is larger than a desired thickness capable of preventing corona discharge of the insulated electric wire D2, it is considered as a good product. On the other hand, the insulated electric wire D2 having a thinner secondary coating layer C is considered as a defective product.

Here, when the insulated electric wire D2 is wound up, the insulated electric wire D2 is pulled up by the pull-up unit 12 and then wound up by the electric wire winding unit 13. Here, the pull-up speed is set up 2~5% higher than the pull-up speed of the pull-up unit 6. This is because the primary coated electric wire D1 is extended along the lengthwise direction by the pre-heating process. Thus, the pull-up speed of the pull-up unit 12 is set up higher to thereby preventing the insulated electric wire from being loosened.

FIG. 3 illustrates an insulated electric wire D2 manufactured through the above described processes. Here, the conductor A is formed of oxygen-free copper. The enamel-baking layer B1 of the primary coating layer employs polyamideimide resin without adding an adhesiveness enhancer. The secondary coating layer C employs PPS resin among others, for the purpose of application to automobile motors. PPS resin has good heat-resistance and flexibility, and thus is one of materials suitable to use as a resin extrusion part of the resin extrusion type and also to application to automobile motors.

Here, the conductor A is drawn to have a flat cross-section, for example, the thickness T1=2 mm and the width W=3.5 mm. Then, a primary coating layer B is coated with a thickness T2 of 40 μm. Formed on the primary coating layer B is a secondary coating layer C having a thickness T3=140 μm, thereby obtaining the insulated electric wire D2.

At this time, in the electric wire pre-heating unit 7, the enamel-baking layer B1 of the primary coated electric wire D1 is pre-heated to have the surface temperature of 270~300° C., which is a temperature capable of sufficiently softening the surface of the enamel-baking layer B1. Then, the primary coated electric wire is supplied to the resin extrusion unit 9. In the resin extrusion unit 9, a secondary coating layer C is extruded and formed on the softened primary coating layer B, while the furnace temperature remains approximately at 280~320° C.

As the result, the insulated electric wire D2 is found out to have a corona discharge initiation voltage Vp of 1200 V and a bonding strength of about 100 mg/mm.

INDUSTRIAL APPLICABILITY

As described above, according to the method of and the apparatus for producing an insulated electric wire according to exemplary embodiments of the invention, a primary coating layer B including at least an enamel-baking layer B1 is formed on a metallic conductor A to form a primary coated electric wire D1. A secondary coating layer C is formed on the primary coating layer of the primary coated electric wire D1 to produce an insulated electric wire D2 having a desired cross-sectional shape. At this time, the surface of the primary coating layer B is pre-heated by the electric wire pre-heating unit 7 in the electric pre-heating process e. The secondary coating layer C is extruded and formed on the pre-heated primary coating layer B, by means of the resin extrusion unit 9 in the resin extrusion process g. Thus, the adhesiveness of the primary coating layer B to the secondary coating layer C can be improved. Even in case where the material, size and the like of the insulated electric wire D2 are varied, the bonding strength between the primary coating layer B and the secondary coating layer C can be easily stabilized. Therefore, a quality anti-corona discharge insulated electric wire can be manufactured in a stable and cost-saving manner.

Further, in case where the outermost layer of the primary coating layer B is formed of an enamel-baking layer B1, the surface of the primary coating layer B is heated up to above the glass transition point Tg of the enamel-baking layer B2 in the electric wire pre-heating process e. Thus, the surface of the enamel-baking layer B1 is softened and the adhesiveness of the primary coating layer B against the second coating layer C can be more reliably improved.

Furthermore, with respect to the primary coating layer B, where a process for forming on the enamel-baking layer B1 an adhesive layer B2 that is bonded with the secondary coating layer C, the surface of the primary coating layer B is pre-heated up to above the glass transition point Tg of the adhesive layer B2. Therefore, the surface of the adhesive layer B2 is softened and the adhesiveness of the primary coating layer B against the secondary coating layer C can be more reliably improved.

Further, in case where the extrusion resin forming the secondary coating layer C on the enamel-baking layer B1, which is the outermost layer of the primary coating layer B, is added with an adhesiveness enhancer, the surface of the enamel-baking layer B1 is pre-heated in the electric wire pre-heating unit 7 up to above a minimum temperature to cause a chemical reaction between the adhesiveness enhancer and the enamel-baking layer B1. Thus, the chemical reaction between the adhesiveness enhancer and the enamel-baking layer B1 can be more reliably performed, and the adhesiveness of the primary coating layer B with the secondary coating layer C can be more reliably improved.

Further, in the electric wire pre-heating process e, the surface of the primary coating layer B is pre-heated to below the thermal decomposition temperature of the primary coating layer B and the secondary coating layer C. Thus, degradation of the primary coating layer B and the secondary coating layer C can be avoided.

Furthermore, in the electric wire pre-heating process e, the surface of the primary coating layer B is pre-heated without contacting the primary coated electric wire D1. The secondary coating layer C can be extrusion-formed without causing any deformation on the surface of the primary coating layer B.

In addition, the pre-heated primary coated electric wire D1 is straightened by the electric wire-straightening unit 8 and then supplied to the resin extrusion unit 9, thereby preventing fluctuation in the thickness of the extruded resin.

Further, the insulated electric wire D2 is cooled and also the cooled insulated electric wire D2 is measured for its thickness. Thus, even in the case where the manufacturing conditions are changed in each process, preferably an electric wire having an appropriate thickness of resin coating to prevent corona discharge can be manufactured. Furthermore, preferably after forming a coating, a defective product having a thinner resin coating layer can be found in the thickness measuring process and can be deposed of.

In addition, the primary coated electric wire D1 is preheated and coated with the extruded resin in a tandem arrangement, without being wound up in a bobbin or the like. Moisture can be prevented from being absorbed and stagnant inside the primary coating layer D1.

Further, PPS resin is less expensive than for example enamel varnish or the like, and also has a good shaping property among resin materials suitable to use in the resin extrusion unit. In addition, the PPS resin is suitable for being extruded uniformly on the primary coating layer D1 coated on the conductor A. Thus, the PPS is desirable as an extrusion resin constituting the secondary coating layer C.

As described above, the method and apparatus for producing an insulated electric wire D2 according to this embodiment can produce a quality insulated electric wire having a corona discharge resistance in stable and cost-saving manner.

On the other hand, the method and apparatus for producing an insulated electric wire is not limited to the above embodiments.

For example, the materials, thickness and width of the conductor A, the enamel-baking layer B1, the adhesive layer B2 and the secondary coating layer C are not limited to the above embodiments, but can be changed depending upon applications.

In addition, for example, before rolling, the conductor A may have a cross-section of circular shape, egg shape, flat shape, oval shape or the like. In addition, the material of the conductor A may employ, for example, aluminum, silver, copper or the like, having electrical conductivity. Mainly, gold is used, and in this case lower oxygen copper or oxygen-free copper can be appropriately used, along with pure copper. Further, in case where pure copper is rolled, the reduction rate in the pair of rolls is preferably 5~30%, in view of prevention of wire breakage, dimension of rolled product and stability, most preferably 10~25%. Where a high reduction rate is required, the rolling process may be repeated several times, or a plurality of tandem rolls may be used.

In addition, the extrusion resin constituting the secondary coating layer C, along with PPS resin, may employ polyolephine resin such as polyethylene resin, polypropylene resin, ethylene copolymer constituting ethylene as one of monomers, and propylene copolymer constituting propylene as one of monomers, polyvinylchloride resin, fluorine resin or the like. Furthermore, condensation copolymer resin having a good heat-resistance such as polyester resin, polyamide resin, polyimide resin, polyamideimide resin, polyesterimide resin, polysulfone resin, polyethelsulfone resin and the like may be employed. In addition, resins including many aromatic rings and imide bonds (polyimide, polyamideimide, polyesterimide and the like) are excellent in heat-resistance, abrasion-resistance, and chemical stability and thus can be appropriately used in particular.

In the above embodiments, the pair of rolls 3A rolls a conductor A having a circular cross-section. Thus, the main face along the axial direction has same diameters and these rolls are disposed approximately in parallel. If other shape of cross-section, besides the flat cross-section, is desired, a roll having the corresponding cross-section can be used.

In the embodiments of the present invention, the conductor supply means corresponds to the conductor supply unit 2, the conductor processing means to the conductor processing unit 3, the conductor annealing means to the conductor annealing unit 4, the coat baking means to the coat-baking unit 5, the electric wire pre-heating means to the electric wire pre-heating unit 7, the electric wire straightening means to the electric wire-straightening unit 8, the resin extrusion means to the resin extrusion unit 9, the electric wire cooling means to the electric wire-cooling unit 10, the coat thickness measuring means to the coat thickness-measuring unit 11, and the electric wire winding means to the electric wire winding unit 13.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of producing an insulated electric wire, in which a primary coating layer including at least an enamel-baking layer is formed on a conductor formed of a metal to form a primary coated electric wire, and a secondary coating layer is extruded on the primary coating layer of the primary coated electric wire to produce the insulated electric wire, comprising:

a conductor supply process of continuously supplying the conductor with a conductor supply unit;

a coat baking process of baking and forming the primary coating layer on the conductor with a coat baking unit;

a first pull-out step of pulling the conductor with the primary coating layer formed thereon at a first pulling speed with a first pull-out unit;

an electric wire pre-heating process of pre-heating the primary coated electric wire with the primary coating layer formed thereon in the coat baking process with an electric wire pre-heating unit;

a resin extrusion process of extruding an extrusion resin to be the secondary coating layer on the primary coating layer of the primary coated electric wire with a resin extrusion unit;

a second pull-out step of pulling the primary coated electric wire with the secondary coating layer formed thereon at a second pulling speed with a second pull-out unit; and an electric wire winding process of winding the insulated electric wire with the extrusion resin coated thereon in the resin extrusion process with an electric wire winding unit, wherein the conductor supply unit, the coat baking unit, the first pull-up unit, the electric wire pre-heating unit, the resin extrusion unit, the second pull-unit, and the electric wire winding unit are arranged in a tandem arrangement, an entire process from the conductor supply process to the electric wire winding process is consistently carried out, in the electric wire pre-heating process, a surface of the primary coating layer is pre-heated up in a non-contact state with the primary coated electric wire to a temperature above a glass transition point of an adhesive layer and below a thermal decomposition temperature of the primary coating layer and the secondary coating layer when the adhesive layer is formed on the enamel-baking layer of the primary coating layer to be bonded to the secondary coating layer, and the adhesive layer is an outermost layer of the primary coating layer, and said second pulling speed is set higher than the first pulling speed.

2. The method of producing the insulated electric wire according to claim 1, further comprising an electric wire straightening process of straightening the primary coated electric wire thus pre-heated in a substantially straight shape with an electric wire straightening unit and supplying the primary coated electric wire to the resin extrusion unit.

3. The method of producing the insulated electric wire according to claim 1, further comprising an electric cooling process of cooling the insulated electric wire having the secondary coating layer extruded thereon with an electric wire cooling unit, and a coat thickness measuring process of measuring a resin coat thickness of the insulated electric wire thus cooled with a coat thickness measuring unit.

4. The method of producing the insulated electric wire according to claim 1, wherein said extrusion resin constituting the secondary coating layer is polyphenylene sulfide resin.

* * * * *